US005952964A

United States Patent [19]

Chan

[11] Patent Number: 5,952,964

[45] Date of Patent: Sep. 14, 1999

[54] PLANAR PHASED ARRAY ANTENNA ASSEMBLY

[75] Inventor: James K. Chan, Rancho Palos Verdes, Calif.

[73] Assignee: Research & Development Laboratories, Inc., Culver City, Calif.

[21] Appl. No.: 08/880,734

[22] Filed: Jun. 23, 1997

[51] Int. Cl.[6] ..... H01Q 3/22

[52] U.S. Cl. ..... 342/368

[58] Field of Search ..... 342/368, 371, 342/372, 373

[56] References Cited

U.S. PATENT DOCUMENTS 4,731,614 3/1988 Crane ..... 342/372

*Primary Examiner*—Gregory C. Issing

*Attorney, Agent, or Firm*—Loeb & Loeb LLP

[57] ABSTRACT

A new planar phased array antenna is disclosed having M by N antenna cells with only M+N phase shifters. A grid of M+N feed lines with the M feed lines at a first frequency having a uniquely controllable phase and N feed lines at a second frequency with each feed line having a uniquely controllable phase are provided separating adjacent cells in the matrix. By coupling an antenna element through a mixer to one row and column feed, a phase for each antenna element in the array can be uniquely controlled through a scan, thereby providing a simplified planar array to be implemented as a patch antenna.

4 Claims, 7 Drawing Sheets

CONVERSION GAIN = 8 TO 10 dB

PLANAR PHASED ARRAY ANTENNA ASSEMBLY

BACKGROUND OF THE INVENTION

1. Area of the Invention

This invention relates to phased array antenna and more particularly relates to a phased array antenna having M+N phase shifters for an M by N antenna array.

2. Description of the Prior Art

Conventional phased array antennas are commonly used in conventional systems where the transmitter, a target for radar, or the receiver, is mobile. By altering the relative phasing of a group of radiating or receiving elements with respect to each other, the beam produced by the overall antenna or the gain pattern of a receiving antenna may be altered or steered.

Typical phased array antennae require complicated three dimensional structures. In the typical antenna array of M by N elements, M and N being integers with at least one of M and N being greater than one, there is a requirement of M times N phase shifters to steer the antenna beam. For an array of ten by ten elements, one hundred phase shifters are required, contributing greatly to the complexity and overall cost of the system.

In addition, incorporating such phase arrayed antennas in patch antennas such as may be used in an aircraft or a vehicle engenders several difficulties. Distribution of the phase array signals from the M times N phase shifters to M times N antenna elements within the array often results in a complicated three dimensional feed structure. Each feed line from the M times N phase shifters will be routed to a different one of the antenna elements and may have to cross several of the feed lines for other elements. Since each line must be insulated from the other lines where they cross, that results in a complex, multilayer structure. Further, the lines must be carefully routed so that the signal on one feed line is not cross coupled to another feed line, causing harmful interference. In addition, the large number of lines that must be routed near each other can also cause problems with impedance matching, requiring an even more complex structure with multiple layers and apertures or feedthroughs between different layers.

If multiple layers are used, the multiple layers also result in a thicker structure. This may cause problems with implementing patch antennas on streamlined surfaces such as airliners.

Therefore, it is a first object of the invention to provide an essentially planar phased array antenna structure to permit a streamlined patch antenna. It is a second object of the invention to provide a simplified feed structure. It is a third object of the invention to provide such a feed structure with fewer phase shifters for controlling the antenna elements within the array. It is yet another object of the invention to provide a phased array antenna that is inexpensive to fabricate.

SUMMARY OF THE INVENTION

These and other objects are achieved by the disclosed embodiments that may include an M by N matrix of antenna cells elements with M+N phase shifting elements. Each antenna cell comprises a row and a column coupler, a mixer element and an antenna element. Row and column feed circuitry provides a phase shifter for each row feed line and column feed line separating the various cells in the matrix from the adjacent cells in the matrix.

The phase of each of the lines is independently controllable and a unique pair of signals, one from a row feed line and one from a column feed line, is coupled into a cell, thereby providing a uniquely controllable phase for the signal of the cell. This uniquely controllable phased signal can then be radiated by the antenna element in the cell so that the phase of each cell is controllable so that the phased array may perform a scan. Alternatively, the uniquely controllable phase signal of a cell may be provided to a down converter mixer so that the antenna can perform a receiving scan.

This structure permits reducing substantially the number of phase shifters and feed lines in the array, thereby permitting a generally planar feed structure and array producible at a greatly lowered cost.

DETAILED DESCRIPTION OF THE PREFERRED EMBODIMENTS

Figure 1:
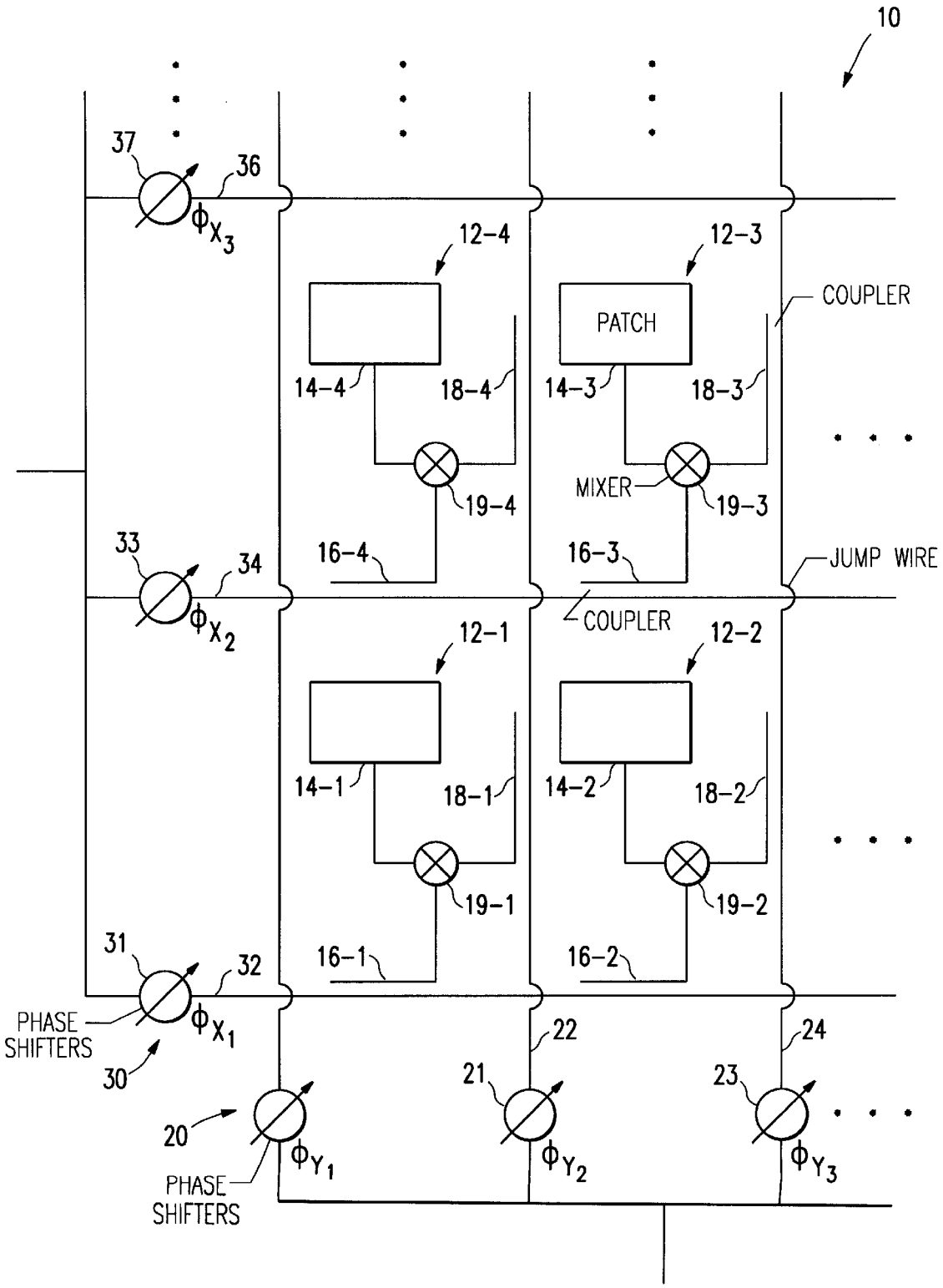
FIG. 1 is a skeletal diagram of an embodiment of the disclosed invention.

FIG. 1 shows a schematic diagram of a two by two portion of a matrix of N rows by M columns of an embodiment 10 of the phased array antenna along with associated circuitry 20, 30. Each cell of the matrix respectively 12-1, 12-2, 12-3 and 12-4 includes an antenna element respectively 14-1, 14-2, 14-3 and 14-4; a row coupler respectively 16-1, 16-2, 16-3 and 16-4; a column coupler respectively 18-1, 18-2, 18-3 and 18-4; and a mixer 19-1, 19-2, 19-3 and 19-4. Separating adjacent cells are column feed lines 22, 24 and row feed lines 32, 34 and 36. Each of the feed lines is respectively coupled to a row or a column line phase controllers 21, 23, 31, 33, and 37. Where the feed lines cross, jumps are provided to isolate the lines from each other.

If the antenna is transmitting at twelve gigahertz, a signal of a first lower frequency such as nine gigahertz is provided to the column feed circuitry 20 and a signal of a second lower frequency such as three gigahertz is provided to the row feed circuitry 30. The phase controllers of the respective column and row feed circuitry, which are controllable by external control signals (not shown) alter the phase of the signal feed along each of the individual feed lines so that the relative phase of the signal on any individual one of the row feed lines is freely alterable with respect to the other row feed lines and the phase of any of the individual ones of the column feed lines is freely alterable with respect to the other column feed lines. In a given cell, the row coupler 16-n couples the three gigahertz signal having the uniquely controllable phase on the adjacent feeder line into the cell and the column coupler 18-n couples the nine gigahertz signal having a uniquely setable phase into the cell. These signals are mixed at the mixer 19-n, which may be a Schottky diode mixer to provide a twelve gigahertz signal having a uniquely setable phase determined by the phases of the constituent three and nine gigahertz signals. The twelve gigahertz signal is then coupled to an antenna element 14-n that acts as a radiator in this example. The phase of the signal being radiated by the antenna element 14 in each individual cell is uniquely setable relative to the phase of the other twelve gigahertz signals being radiated by other antenna elements 14-n based upon the combination of the setable signals on the feed lines mixed in the other cells.

Figure 2:
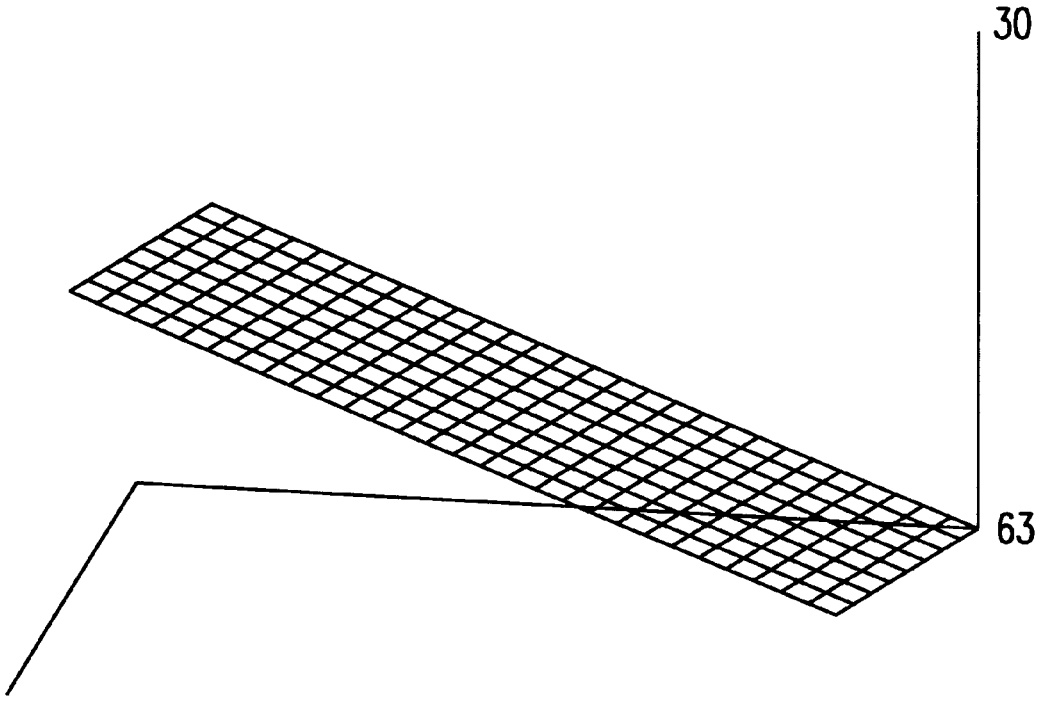
FIG. 2 is a chart of a scan producible by an array of the disclosed embodiment.

Since the relative phase of each of the antenna elements may be set by altering the phase on the feed lines, the directional gain of the antenna is steerable as shown in FIG. 2. In particular, in FIG. 2, the gain pattern of the antenna is controlled by selecting the individual phases for the M column signals and N row signals phases so that the phase at each of the antenna elements progressively sweeps in a direction across the array to provide a scan across the same direction.

Figure 3:
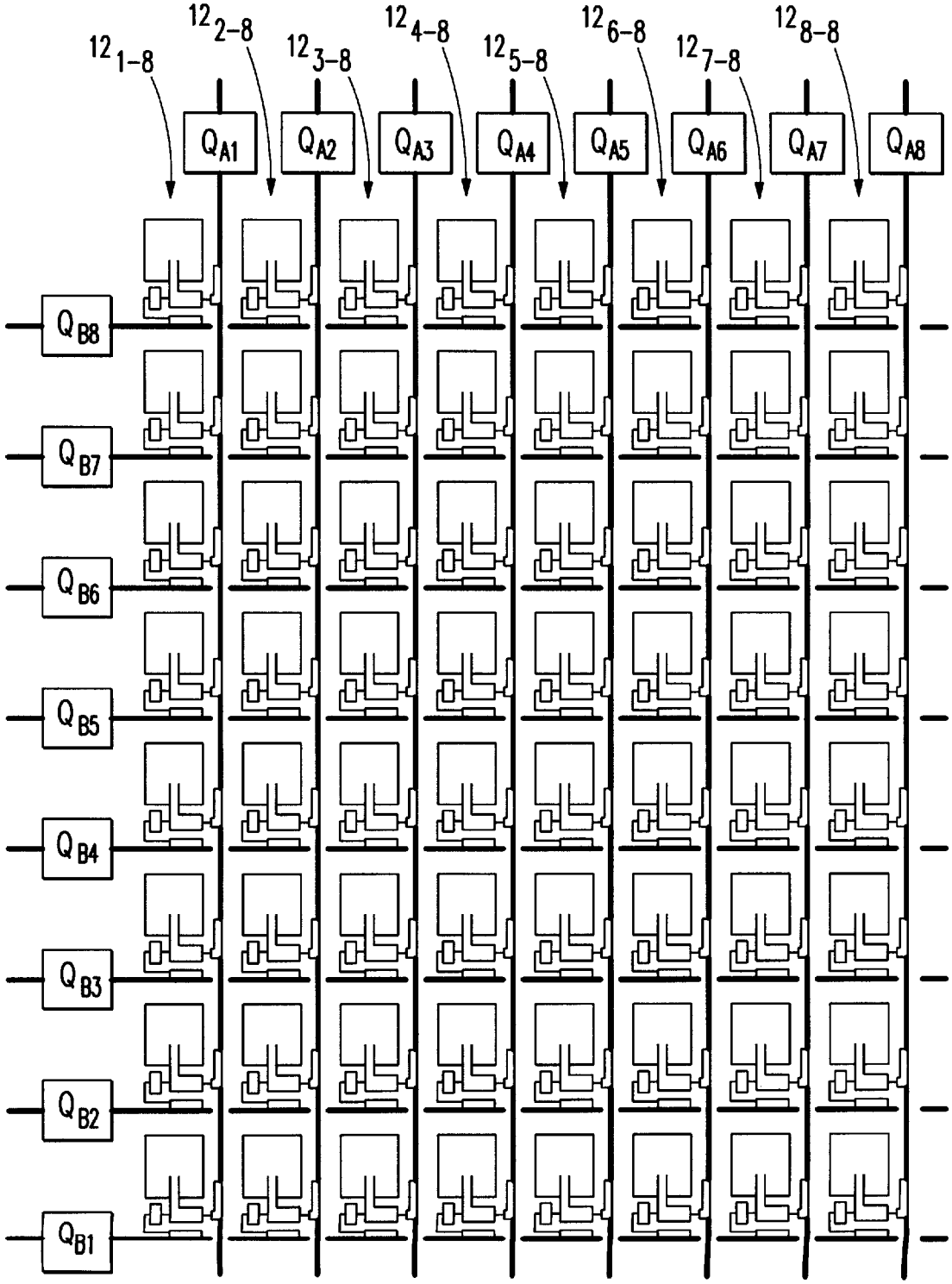
FIG. 3 is a top view of a metallization pattern of an embodiment of the invention.

FIG. 3 shows the metallization pattern 100 for the upper surface an eight by eight array of sixty-four antenna cells for a transmitting along with sixteen phase adjusters including column phase adjusters $\phi_{A1}$–$\phi_{A8}$ and row phase adjusters $\phi_{B1}$–$\phi_{B7}$. As can be seen in FIG. 3, the column feed lines coupled to adjusters $\phi_{A1}$–$\phi_{A7}$ pass over the row feed lines coupled to row phase adjusters $\phi_{B1}$–$\phi_{B7}$. The metallization pattern is formed on the upper surface of an insulating dielectric such as 0.032" Duroid available from Rogers Corporation.

The metallization pattern can be formed readily using photo-lithographic techniques such as those commonly used in printed circuit board manufacture. Jump wires may be formed by forming the entire metallization pattern including for example the row feeds but omitting the metal for the portion of the column feeds where the row and column feed lines would intersect. Using further photo lithographic techniques, a dielectric such as Duroid may be deposited over the metal of the row feed line where an intersection would occur and then form additional metallization over that point to complete the column feed lines by providing "jump wire" metallization at the intersections.

A single ground plane (not shown) is preferably formed underneath the dielectric throughout the array. The ground plane causes the feed lines to act as transmission lines and to suppress radiation from the array to minimize back lobes formed under the metallization. Because each of the feed lines is a transmission line, each cell should preferably be located an integer multiple of the row wave length from adjacent cells on the row and an integer multiple of the column wave length from adjacent cells on the column.

Figure 4:
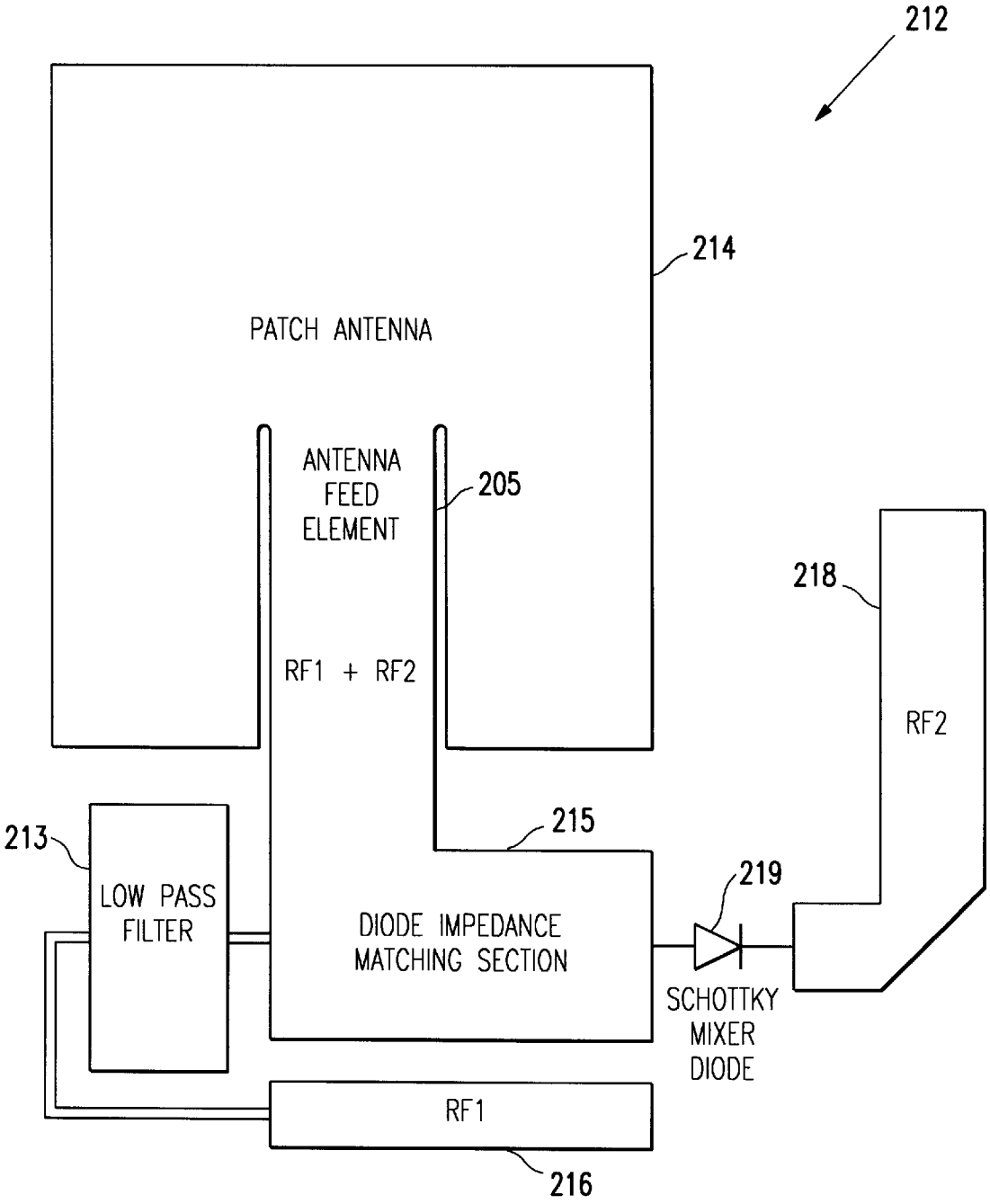
FIG. 4 is a more detailed schematical view of a cell of an embodiment of the invention for use in FIG. 3.

FIG. 4 shows a detailed view of the metallization of one cell 212 for a transmitting antenna. Included in the patch antenna element 214 are row and column couplers 216 and 218 respectively that couple to the adjacent row and column feed lines (not shown). A low pass filter metallization pattern 213 passes the lower frequencies such as three gigahertz from the adjacent row feed line (not shown) but blocks the higher frequency signals from the column feed line (not shown) such as nine gigahertz and the mixed signal. The three and nine gigahertz signals feed lines from the respective row and column feed lines are mixed to form the twelve gigahertz signal at a diode mixer 219, which may be a Schottky diode formed on the unplated surface by known techniques. Pattern area 215 provides impedance matching to the diode 219 and provides the mixed RF energy of the mixed frequencies (twelve gigahertz here) to an antenna element 212 through a feed element pattern 205.

To transmit information, either the nine or the three gigahertz signal is modulated with information before being fed to a phase adjuster for providing either the row or the column signal feeds. Thus, modulated information is transmitted and the direction of transmission of the information can be steered or controlled by altering the phases on the column and the row feeds.

Figure 5:
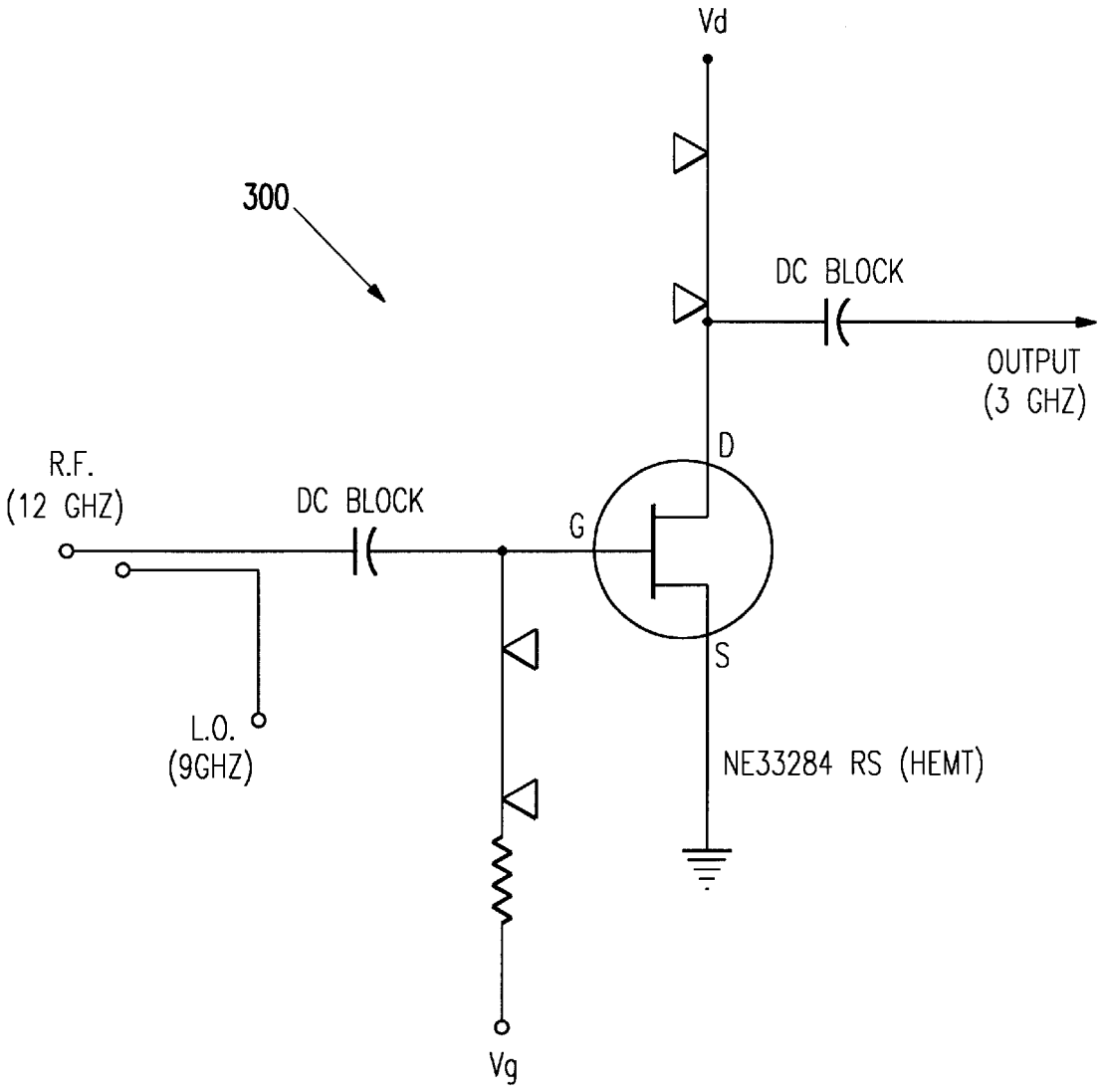
FIG. 5 is a diagram of a down converter mixer for use in an embodiment of the invention.

For receiving transmitted signals, a different structure needs to be implemented with the RF feed from the antenna element being coupled to an active mixer down converter 300 such as shown in FIG. 5. Preferably, the mixer circuit is formed within the antenna cell and comprises an amplifier with DC blocking capacitors, DC biases and a NE33284RS FET. The local oscillator input, which may be nine gigahertz in each mixer is coupled to a diode mixer to provide an uniquely controllable phase for the down converter. In this embodiment, rather than use a homodyne receiver, the first and second frequencies for the row and column feed signals are combined at the mixer in each cell to be nine gigahertz signal. For example, the row frequency may be three gigahertz and the column feeds being six gigahertz. Further, the phases on each of the rows and each of the columns are different and controllable as described above so that the mixings provide uniquely controllable phases to be fed to each local oscillator for receiving the signal. Of course, the phases of each element can be controlled in the manner described above for performing a scan in the row or column directions or in any other direction.

Figure 6:
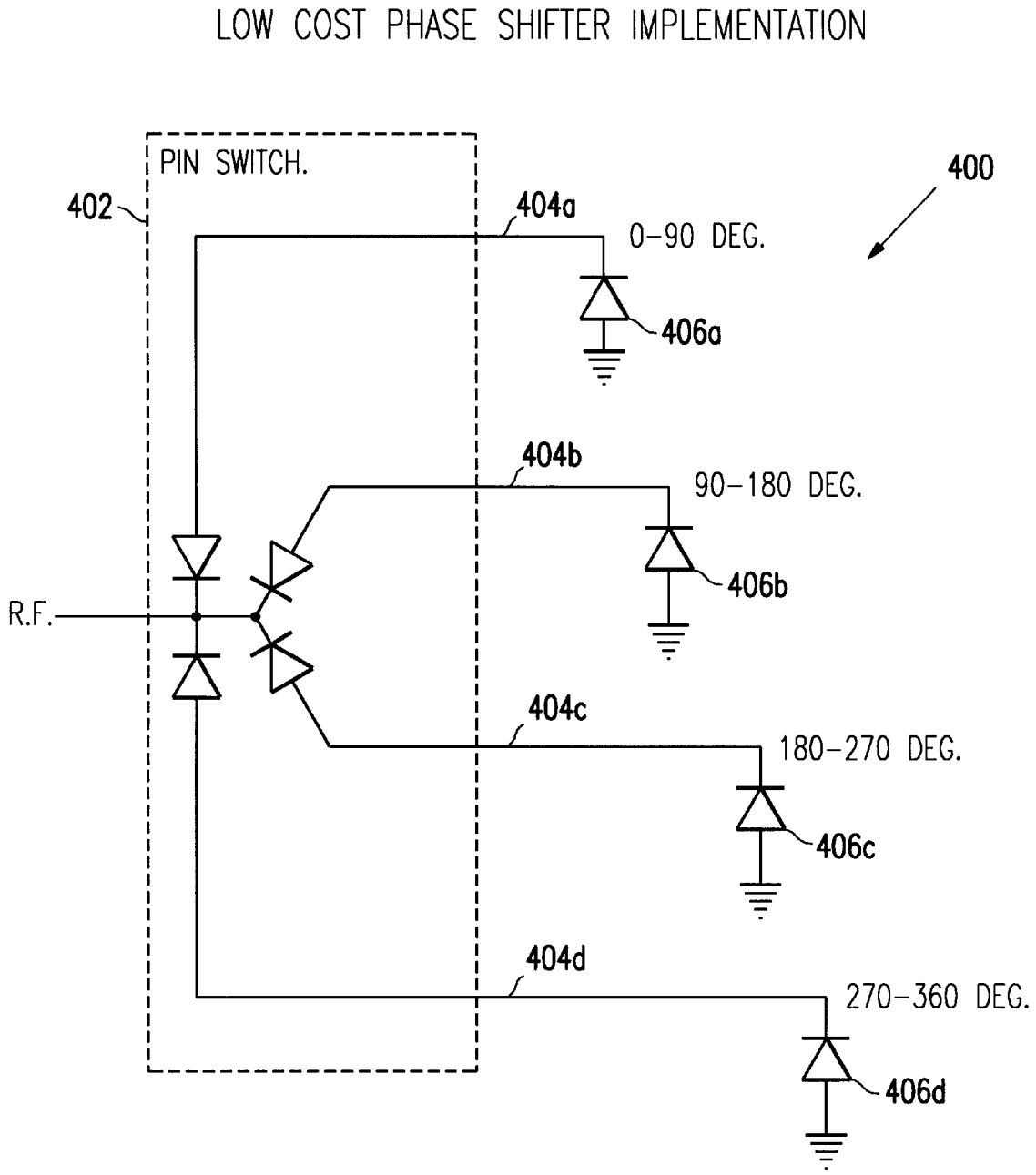
FIG. 6 is a phase shifter for an embodiment of the invention.

FIG. 6 shows a phase shifter implementation 408 that, for example, provides four orthogonal phases. The phase shifter may include a PIN switch 402 such as a beam lead PIN diode available from Metelics Corporation that receives a signal at either the column or the row frequency. The PIN switch 402 provides in this embodiment four separate feeds that may then be coupled to four separate transmission lines 404*a–d* formed on the substrate and having different predetermined lengths. This provides relative to the other lengths of transmission lines a signal having a first phase but at the same frequency. A varactor diode 406*a–d* having a control line (not shown) is coupled to each of the different length transmission lines for altering the phase on the given transmission line. Although only four phase signals having different signals are shown, obviously by providing other signals with other lengths of transmission lines, additional phase shifted signals may be provided.

Figure 7:
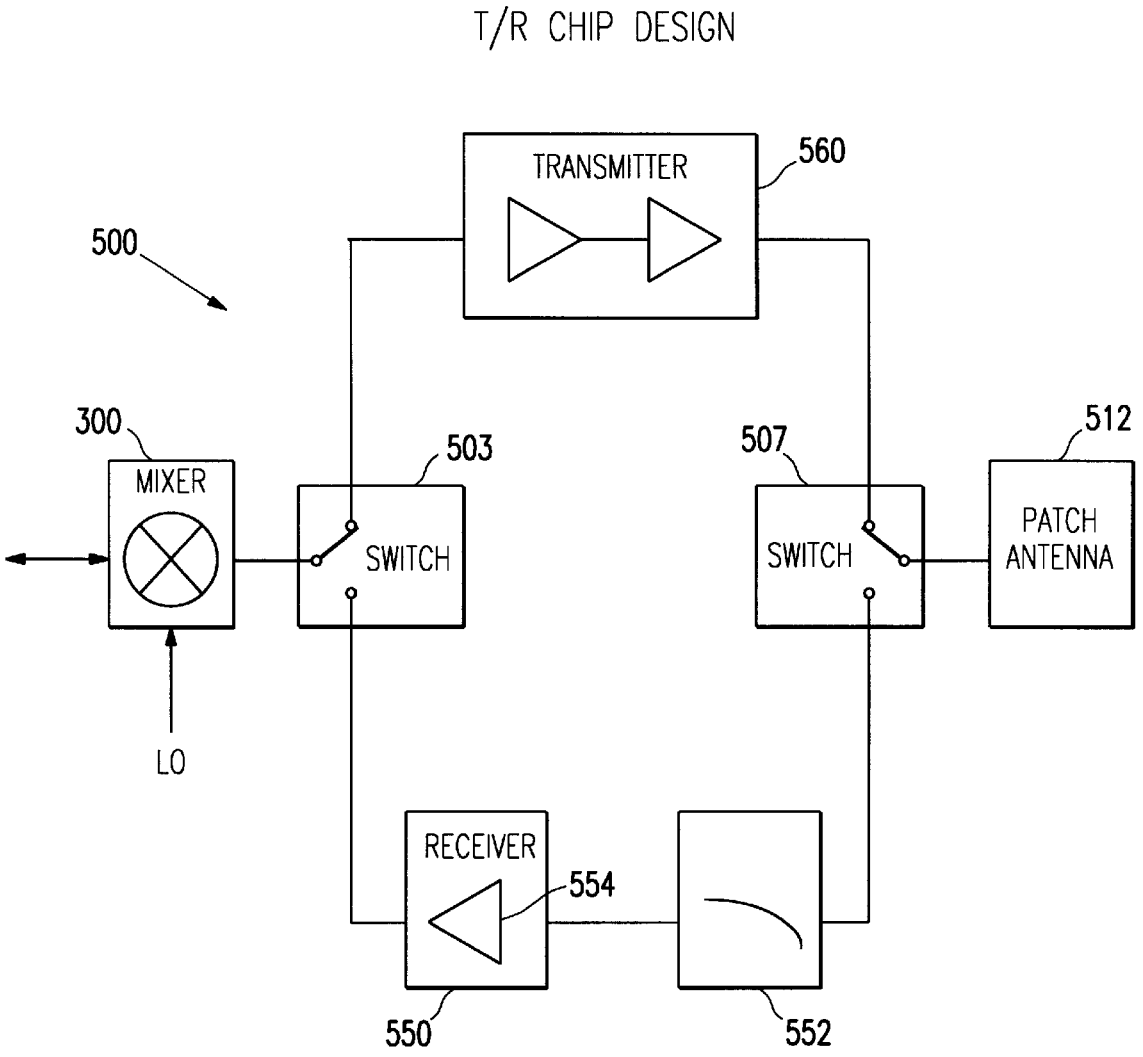
FIG. 7 is a second embodiment of the invention as a transmitter and receiver.

FIG. 7 shows a block diagram of an integrated transmitter/receiver design where each antenna element 512 of each cell is coupled through switches 503 and 507 to a mixer 300 where the mixing takes place to provide the coupling to the row and column couplers for providing the uniquely controllable phase signal. Receiver 550 includes a low pass filter 552 and amplifier 554 while the transmitter includes a power amplifier 560. Hence, one conformal patch antenna can be used for both transmission and reception.

Utilizing the disclosed embodiments, a conformal phased array antenna can be achieved having a greatly simplified structure. In particular, the number of phase shifting elements are greatly reduced and the feed structure is also reduced. A metallization pattern can be readily imprinted on a dielectric using conventional photo-lithographic techniques.

As a result of the disclosed embodiments, a phased array antenna can be provided having an insertion loss of 5–8 dB with a passive front end such as diode mixers and a 1–2 dB loss with an active front end. In addition, the phase shift resolution can be analog with no control wires required per element. Overall system complexity and cost is minimized and a reduction in phase shifters for typical implementations is almost one order of magnitude.

While the specifically disclosed embodiments are optimally implemented as a conformal patch antenna, the same principles may be applied to other types of phased array antennas to minimize the phase shifting elements and the array feed structure. Of course, those of ordinary skill in the field will recognize that other embodiments are also possible and the scope of the invention should be measured by the claims.

I claim:

1. A phased array antenna having a gain pattern comprising:

a plurality of patch antenna elements arranged in an array of columns and rows having a periphery;

a separate mixer coupled to each of the patch elements;

a matrix of column and row feeder lines, each antenna element separated from the adjacent antenna element by a row feeder line and a column feeder line, each row feeder line being coupled to each mixer in a row of the antenna elements adjacent to the feeder line and each column feeder line being coupled to each mixer; and wherein said mixer couples one of said feeder lines to the antenna element and a filter couples the other of said feeder lines to the antenna element.

2. The antenna of claim 1, wherein each of the antenna element, mixers, filters and couplers are formed on the same surface.

3. The antenna of claim 2, wherein each of the row and column feeder lines are formed essentially on the same surface.

4. The antenna of claim 3, wherein one of the row and column feeder lines is raised off of the surface where the row and column feeder lines cross.

* * * * *